US006143393A

United States Patent [19]

Abe et al.

[11] Patent Number: 6,143,393

[45] Date of Patent: Nov. 7, 2000

[54] CLEANING PRODUCT AND PRODUCTION PROCESS THEREFOR

[75] Inventors: Kouzou Abe; Yasuhiko Kenmochi; Masatoshi Fujiwara; Yoshinori Tanaka, all of Mitoyo-gun, Japan

[73] Assignee: Uni-Charm Corporation, Ehime, Japan

[21] Appl. No.: 09/213,026

[22] Filed: Dec. 16, 1998

Related U.S. Application Data

[63] Continuation-in-part of application No. 09/200,093, Nov. 25, 1998, abandoned.

[30] Foreign Application Priority Data

Dec. 16, 1997 [JP] Japan ..... 9-346018

[51] Int. Cl.[7] ..... B32B 5/26; A47L 13/20; A47L 13/16; A47L 13/17

[52] U.S. Cl. ..... 428/131; 428/134; 428/136; 428/137; 428/92; 428/93; 428/195; 428/196; 428/197; 15/208; 15/228; 300/21

[58] Field of Search ..... 15/208, 209.1, 15/228, 229.1, 229.2, 229.4, 229.6, 229.8; 428/134, 136, 138, 92, 93, 137, 195, 196, 197; 300/21

[56] References Cited

U.S. PATENT DOCUMENTS

| | | | |
|---|---|---|---|
| 2,522,691 | 9/1950 | Podolak | 15/229 |
| 3,822,435 | 7/1974 | Moss | 15/229 |
| 4,018,646 | 4/1977 | Ruffo et al. | 162/146 |
| 4,145,787 | 3/1979 | Bastian | 15/229 AW |
| 5,315,734 | 5/1994 | Kresse et al. | 15/229.4 |
| 5,429,854 | 7/1995 | Currie et al. | 428/138 |
| 5,525,397 | 6/1996 | Shizuno et al. | 428/138 |

FOREIGN PATENT DOCUMENTS

| | | |
|---|---|---|
| 0289198 A1 | 4/1988 | European Pat. Off. . |
| 05192284 | 8/1993 | European Pat. Off. . |
| 0774229 A2 | 5/1997 | European Pat. Off. . |
| 0777997 A2 | 6/1997 | European Pat. Off. . |
| 0777997 A3 | 1/1998 | European Pat. Off. . |
| 0774229 A3 | 4/1998 | European Pat. Off. . |
| 5-245090 | 9/1993 | Japan . |
| 9-149873 | 6/1997 | Japan . |
| WO 92/03083 | 3/1992 | WIPO . |

*Primary Examiner*—Ellis Robinson
*Assistant Examiner*—Alicia Chevalier
*Attorney, Agent, or Firm*—Darby & Darby

[57] ABSTRACT

A cleaning product comprises a base sheet and at least one layer of filaments or split yarns oriented in one direction, the base sheet and the layer are stacked and bonded together at a plurality of bonding lines extending in a direction intersecting with the one direction, and the base sheet is cut together with the layer intermittently in the intersecting direction between adjacent bonding lines to form cutting portions, thereby forming brushing portions with the layer. The cleaning product can be produced simply and conveniently at small cost. Further, it also has an excellent dust collecting effect.

27 Claims, 6 Drawing Sheets

CLEANING PRODUCT AND PRODUCTION PROCESS THEREFOR

This application is a continuation-in-part of copending application Ser. No. 09/200,093, filed Nov. 25, 1998 and now abandoned.

BACKGROUND OF THE INVENTION

1. Field of the Invention

The present invention relates to a cleaning product and a process for producing the same. More particularly, this invention relates to a cleaning product which is excellent in a dust collecting performance and is suitable for a disposable product, and a process for producing the same.

2. Description of the Prior Art

As a cleaning product, sheets made of fibers have been used. Among them, disposable products which are made of non-woven fabrics and used being attached to a cleaning tool such as a cleaning mop have been generally on the market since they can be used simply and conveniently.

Japanese Patent Laid-Open H9-149873 discloses a method of manufacturing a disposable wiper having brushing portions. In this wiper, a base sheet and tows of fibers oriented in one direction (filament layer) are stacked, in which the base sheet and the filament layer are bonded at a plurality of bonding lines extending over the entire length of the sheet in a direction perpendicular to the direction described above and, further, only the filament layer is cut continuously and linearly over the entire length of the sheet between adjacent bonding lines, to form the brushing portions from the filament layer. The wiper having the brushing portions is excellent in a dust collecting effect and can collect various kinds of dusts ranging from fine dusts to relatively large crumbs. Further, since the tows are used, the wiper can be produced at small cost.

However, when the brushing portions are formed by cutting the filament layer, it is actually difficult to cut only the filament layer while leaving the base sheet as it is. If the cutting size is not exact, the base sheet is cut together with the filament layer to make the wiper in pieces. Accordingly, the manufacturing step is extremely troublesome. Further, the entire strength of the wiper is not enough.

SUMMARY OF THE INVENTION

An object of the present invention is to provide a cleaning product excellent in a dust collecting effect, which can be manufactured conveniently at small cost.

The foregoing object of the present invention can be attained in a cleaning product comprising a base sheet and at least one layer comprising filaments or split yarns oriented in one direction, said base sheet and said layer being stacked and bonded together at a plurality of bonding lines extending in a direction intersecting with said one direction, said base sheet being cut together with said layer at a plurality of cutting portions aligned intermittently in said intersecting direction, thereby forming a plurality of brushing portions with said filaments or split yarns positioned between the bonding lines and the cutting portions in said one direction.

Further, the cleaning product of the present invention can be obtained by a process for producing a cleaning product comprising the steps of:

feeding a base sheet and at least one layer continuously and stacking said layer to said base sheet, wherein said layer comprises filaments or split yarns oriented in one direction;

bonding said base sheet and said layer at a plurality of bonding lines in a direction intersecting with said one direction to obtain a sheet material;

cutting said sheet material at a plurality of cutting portions aligned intermittently in said intersecting direction, thereby forming a plurality of brushing portions with said filaments or split yarns positioned between the bonding lines and the cutting portions; and separating said sheet material to obtain a cleaning product.

PREFERRED EMBODIMENTS OF THE INVENTION

The present invention will be explained with reference to the drawings.

Figure 1A:
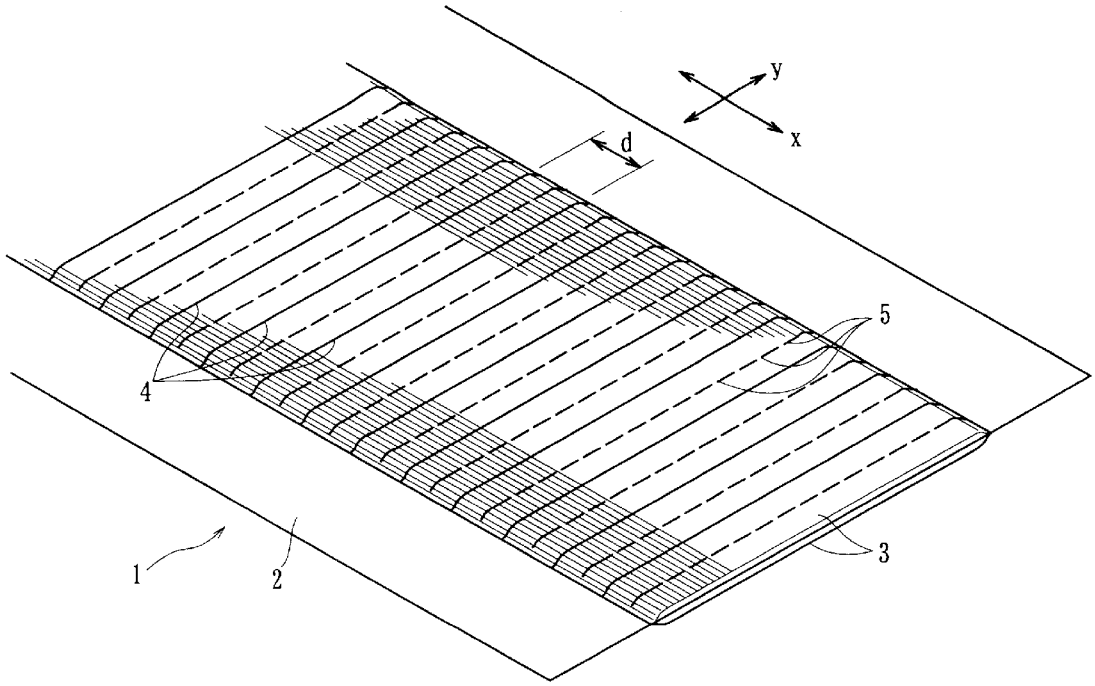
FIG. 1(A) is a perspective view of an example of a cleaning product according to the present invention.
Figure 1B:
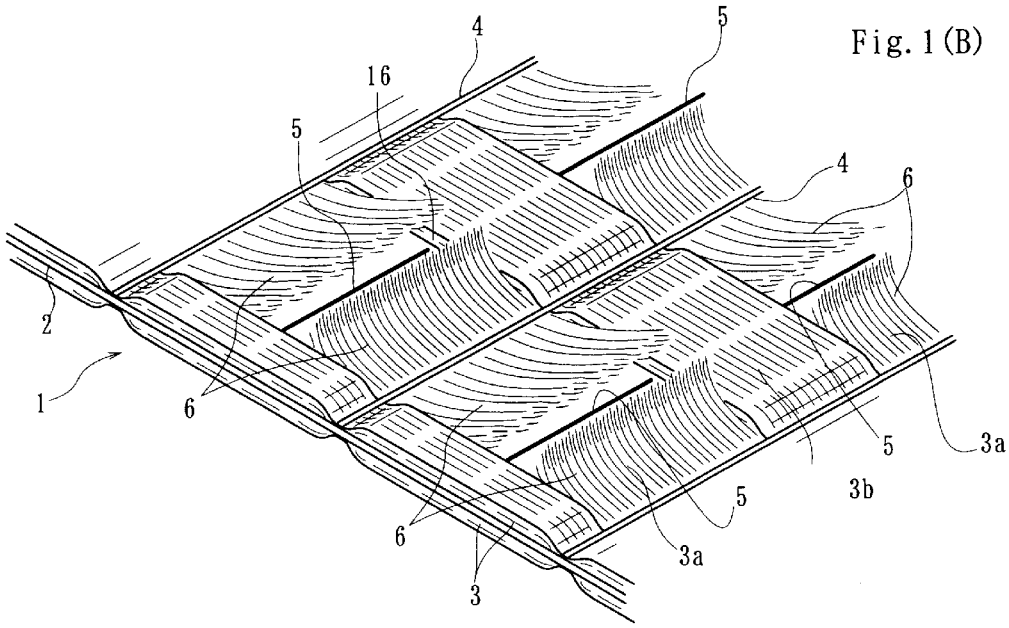
FIG. 1(B) is an enlarged view for a portion of the cleaning product shown in FIG. 1(A)

FIG. 1(A) is a perspective view of a cleaning product according to the present invention and FIG. 1(B) is an enlarged view for a portion of the cleaning product shown in FIG. 1(A).

In a cleaning product 1 shown in FIG. 1(A), layers 3 each comprising filaments or split yarns oriented in one direction are stacked on both surface and rear face of a base sheet 2. The filaments or the split yarns constituting the layer 3 are oriented in one direction so as to extend in a direction "x". Then, bonding lines 4 each extending continuously in a direction "y" perpendicular to the direction "x" are disposed having a predetermined distance "d" between each other in the direction "x". The base sheet 2 and the layers 3 are bonded integrally at the bonding lines 4. Then, the base sheet 2 and the layers 3 are cut together at a plurality of cutting portions 5 aligned intermittently in the direction "y" to form intermittent cutting lines extending in the direction "y", as shown in FIG. 1(A). The cutting lines are arranged in a plurality of rows and each row is put between two bonding lines 4 and 4 adjacent with each other. At the portions where the layers 3 are cut, brushing portions 6 are formed as shown in FIG. 1(B).

As described above, since the cleaning product 1 of the present invention has the brushing portions 6, it provides excellent dust collecting effect capable of removing various kinds of dusts ranging from fine dusts to relatively large crumbs.

As shown in FIG. 1(B), in the cleaning product 1, a layer 3*b* comprising uncut filaments or split yarns remains between adjacent layers 3*a* and 3*a* each comprising cut filaments or split yarns that form the brushing portions 6. Hereinafter, the layer 3*b* is referred to as an uncut portion. The strength of the cleaning product 1 is maintained by the presence of the uncut portions.

In the border region between the brushing portion 6 and the uncut portion, the cross sectional portion 16 of the layer 3 is exposed. Furthermore, a gap having an entrance is preferably formed between the uncut portion and the base sheet 2.

With such structure, when a surface to be cleaned is wiped, the gap functions like a pocket to capture dust. More particularly, when the surface to be cleaned is wiped, dust is caught by the cross sectional portion 16 and comes into the gap between the uncut portion and the base sheet 2. Particularly, even relatively large dust which is difficult to be captured by the conventional cleaning product can be captured in the gap. The captured dust is held among the filaments or split yarns forming the uncut portion and accordingly it is difficult that dust is dispersed around in the wiping operation. Further, since dirt or dust comes into the gap, the dirt is attached to the inside of the layer 3*b* (portion near to the base sheet 2). That is, not only the filaments or split yarns exposed to the surface of the cleaning product 1 become dirty by capture of dust but also the filaments or split yarns within the layer 3*b* become dirty. Accordingly, a multiplicity of filaments or split yarns constituting the layer 3*b* participate in the wiping operation of dust, so that a collection amount of dust by the whole cleaning product 1 can be increased. Furthermore, dirt can be scraped off by the cross sectional portion 16 effectively.

Hence, since the cleaning product of the present invention can capture and hold dust not only with the brushing portions 6 but also with the uncut portions, excellent dust collecting effect can be obtained.

As described above, since the brushing portions 6 are not formed over the entire surface of the cleaning product 1 but formed only at the portions where the cutting portions 5 are situated, the area to form the brushing portions 6 can be controlled properly depending on the number and the position of the bonding lines 4 and the cutting portions 5. That is, the area to form the brushing portions 6 can be controlled properly depending on necessity. Incidentally, while the base sheet 2 and the layers 3 are cut together, the cleaning product 1 is not disintegrated in pieces since cutting is conducted intermittently in the direction "y" i.e., partially. In order to improve the dust collecting effect, it is desirable that the dimension of one cutting portion 5 in the direction "y" is larger than the distance between cutting portions 5 and 5 adjacent with each other in the direction "y" (distance in which the cutting portion 5 is not present). This increases the area to form the brushing portions 6.

Any of materials may be used for the base sheet 2 as long as the material has strength sufficient to withstand for use, such as a non-woven fabric formed by a spun bond method, a resin film, a synthetic fiber-containing cloth or the like.

The layer 3 comprising the filaments or the split yarns is formed of a great number of filaments or split yarns by orienting them in one direction and bundling them. The layer 3 may be formed only with the filaments or the split yarns or may be formed with both of the filaments and the split yarns.

The filaments can be formed into a material generally called as a tow, for example, to be used for the layer 3. The tow means a bundle comprising a number of oriented filaments. The filaments are prepared, for example, from polyethylene, polypropylene, nylon, polyester and rayon. Among them, composite fibers comprising polyester as a core component and polyethylene as a sheath component are preferably used.

The split yarns are prepared from a sheet shaped material such as a non-woven fabric or a film by cutting them into a rectangular shape with an extremely small width. Thus obtained rectangular materials i.e., split yarns are further bundled and used for the layer 3. Well-known non-woven fabric or film can be used. The rectangular material is preferably of a shape having such appropriate thickness and width as capable of catching dusts.

The longitudinal size of the filament or the split yarn may be properly controlled as long as the size is greater than the distance between bonding lines 4, 4 adjacent with each other. Further, the filaments may be crimped as required.

The base sheet 2 and the layer 3 preferably contain a thermoplastic resin. In this case, the layer 3 and the base sheet 2 can be bonded by welding such as heat welding using hot emboss roll or ultrasonic welding. In this method, the thermoplastic resin contained in the base sheet 2 and the layer 3 are welded together to form the bonding lines 4. Alternatively, the bonding lines 4 may be formed with adhesives.

The length of bristles of the brushing portions 6 is determined depending on the distance between the bonding line 4 and the cutting portion 5 and the length is preferably 3 mm or more. If the length of the bristles of the brushing portions 6 is larger than the lower limit described above, the effect of catching hairy dusts is improved.

For easy adsorption of the dusts, an oily agent is preferably incorporated in the cleaning product 1 of the present invention. The oily agent includes mineral oils such as paraffin, synthetic oils such as polyolefin and silicone oil. In addition to the oily agent described above, the cleaning product 1 of the present invention can also be incorporated, for example, with those materials such as deodorant, moistening agent, disinfectant and cleaning chemical such as surfactant.

Figure 2:
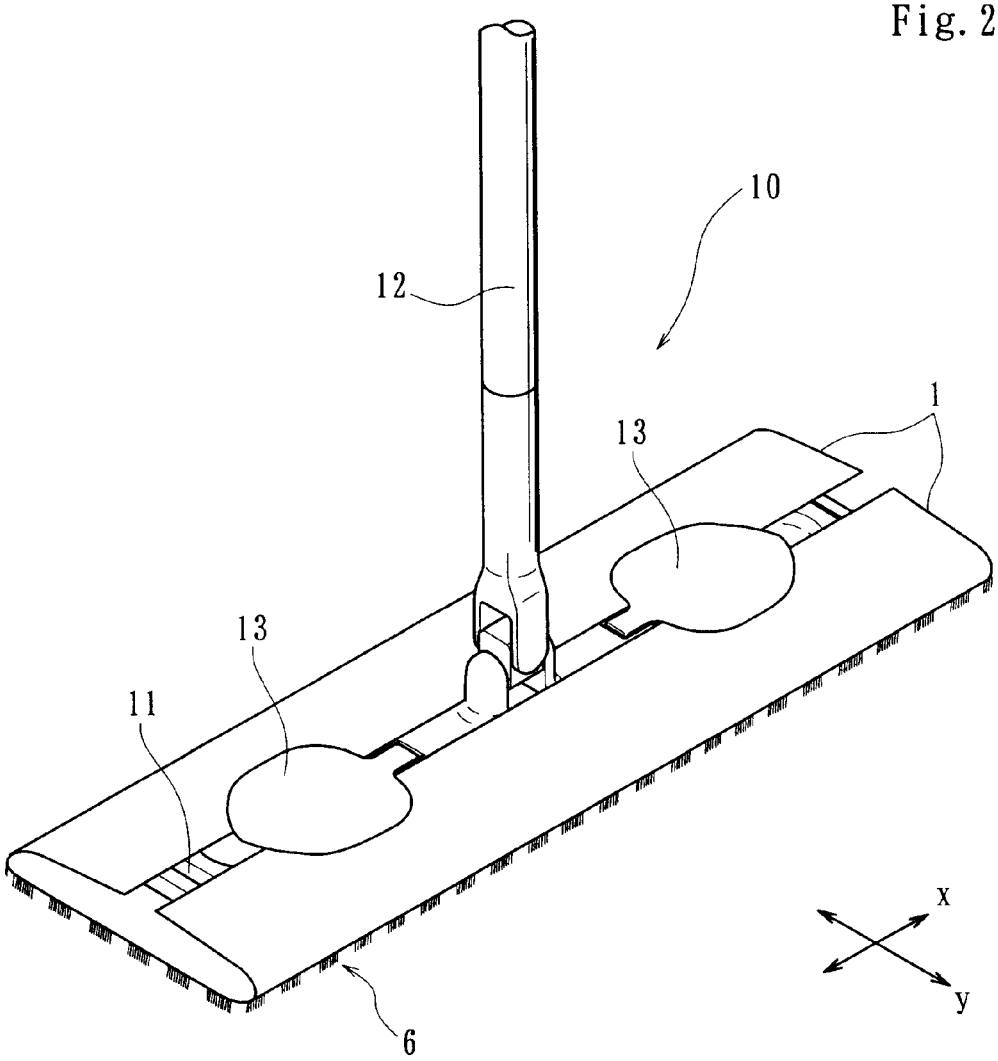
FIG. 2 is a perspective view illustrating an example of a cleaning product according to the present invention which is attached to a cleaning tool.

FIG. 2 shows an example of using the cleaning product according to the present invention.

As shown in FIG. 2, the cleaning product 1 can be used being attached to a cleaning mop 10. In the cleaning mop 10, a shank 12 is attached to a cleaning plate 11. The cleaning product 1 of the present invention is applied to the cleaning product 1 in such a manner that the brushing portions 6 are positioned on the lower surface of the cleaning plate 11 to face an object to be cleaned such as a floor, and both sides of the cleaning product 1 are turned on the upper surface of the cleaning plate 11 and held by means of holding clips 13, 13 to the cleaning plate 11. When the cleaning product 1 of the present invention is used in this state, since both the sides of the cleaning product 1 turned on the upper surface of the cleaning plate 11 are not faced to the object to be cleaned, it is not necessary to form the brushing portions 6 on both the sides. Further, when cleaning is carried out by using the cleaning mop 10 to which the cleaning product 1 is attached, sweeping may be conducted either in the direction "x" or the direction "y".

Figure 3:
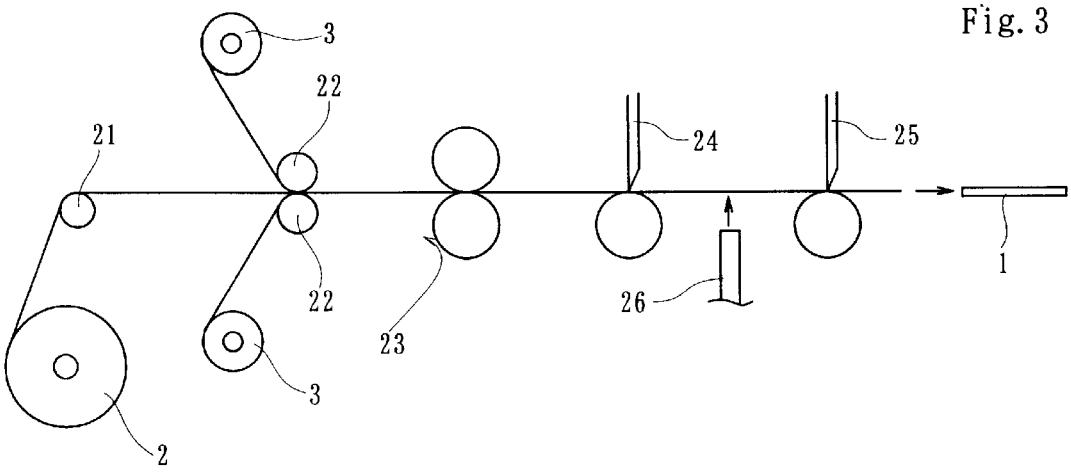
FIG. 3 is a view illustrating an example of production steps for a cleaning product according to the present invention.

FIG. 3 shows an example of production steps for the cleaning product of the present invention shown in FIGS. 1(A) and 1(B).

As shown in FIG. 3, a base sheet 2 wound in a rolled state is at first unwound by a delivery roll 21 and supplied. In the midway of a transportation line of the supplied base sheet 2, layers 3 comprising filaments or split yarns oriented in one direction are disposed respectively each, for example, in a rolled state, and the layers 3 delivered from the rolls are widened to a predetermined width by widening rolls 22 and stacked on both faces of the base sheet 2 in such a manner that the base sheet 2 is interposed between the layers 3. Then, bonding lines 4 for bonding the base sheet 2 and the layers 3 are formed by a bonding machine 23 to obtain a sheet material comprising the base sheet 2 and the layers 3 integrated together.

The bonding machine 23 has a heat emboss roll. The base sheet 2 and the layers 3 are pressed under heating by the heat emboss roll, and the bonding lines 4 are formed by welding of the thermoplastic resin contained therein. The bonding lines 4 are formed in plurality each being spaced apart by the distance "d" in the direction "x" as shown in FIG. 1(A). Ultrasonic waves may be used instead of the heat emboss roll. They may be bonded by using an adhesive instead of welding. However, the heat welding is convenient and preferred.

Cutting portions 5 are formed by a cutter 24 such that the base sheet 2 and the layers 3 integrated together, namely, the sheet material is cut intermittently in the direction "y" (that is, partially) while being spaced apart at a predetermined distance in the direction "x", as shown in FIG. 1(A), so as to penetrate the sheet material. The cutter 24 has a plurality of teeth which are aligned intermittently. Alternatively, the cutting portions 5 can be formed by fusion cutting the sheet material using heat or ultrasonic waves instead of the cutter 24.

After forming the cutting portions 5, the sheet material is separated into a predetermined length by a second cutter 25, to obtain a cleaning product 1.

Figure 4A:
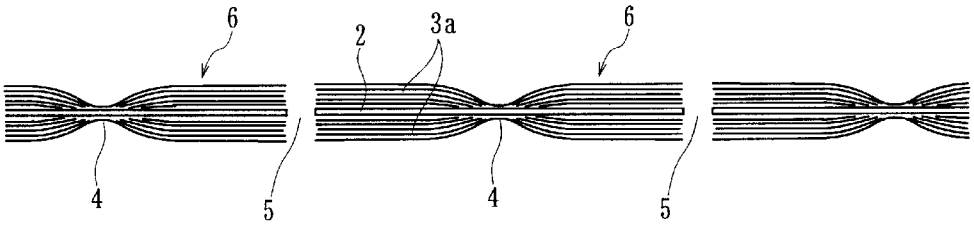
FIG. 4(A) is an enlarged fragmentary cross sectional view showing brushing portions of a cleaning product of the present invention.

FIG. 4(A) is an enlarged fragmentary cross sectional view showing a part of the base sheet 2 and the layers 3 integrated by the bonding machine 23 and partially cut by the cutter 24 in the step of FIG. 3.

The brushing portion 6 is formed from the layer 3*a* comprising the filaments or split yarns being cut by the cutting portion 5 while being bonded at the bonding line 4 to a part of the base sheet 2 as shown in FIG. 4(A). Incidentally, the filaments or the split yarns constituting the layer 3*b* (not shown herein) remain uncut as they are.

Figure 4B:
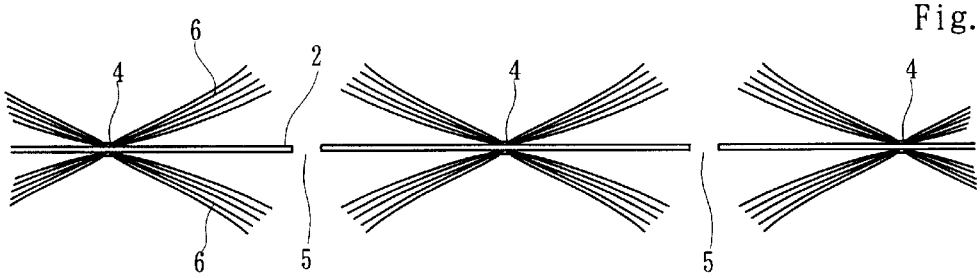
FIG. 4(B) is an enlarged fragmentary cross sectional view showing brushing portions of a cleaning product of the present invention in a fluffed state.

Furthermore, as shown in FIG. 4(B), the filaments or the split yarns forming the brushing portions 6 may be fluffed. As a step of fluffing, a method of blowing air from an air nozzle 26 to the sheet material before the separating step into a cleaning product 1, as shown in FIG. 3, may be adopted. The brushing portions 6 can be fluffed by air. In the case where the brushing portions 6 are formed on both the faces of the cleaning product 1, air is blown from both of upper and lower sides. Alternatively, mechanical force may be applied to both the faces of the sheet material to cause fluffing after the cutting step by the cutter 24 shown in FIG. 3. FIG. 4(B) shows the fluffed state of the brushing portions 6. The fluffed brushing portions 6 can enhance the dust collecting effect. Incidentally, even if the cleaning product 1 is used for wiping operation with the brushing portions 6 in a not fluffed state as shown in FIG. 4(A), the brushing portions 6 are gradually fluffed in the course of use. Therefore, it is not necessary to previously fluff the brushing portions 6. However, in the case of putting the cleaning product 1 of the present invention as finished goods on the market, the dust collecting effect can be attained immediately upon use and it gives a fine appearance if the brushing portions 6 are fluffed before use.

As has been described above, in the present invention, a cleaning product excellent in the dust collecting effect can be produced simply and conveniently. Namely, since the cutting portions to make the layer comprising the filaments and the like into the brushing portions can be formed by cutting the base sheet together with the layer, no delicate control is required in the cutting step, which can facilitate the production process of the cleaning product. Further, since the cutting portions are formed only partially, high strength can be kept all over the cleaning product. Furthermore, when the layer 3 is formed with the tow, the cleaning product can be produced at small cost.

Figure 5B:
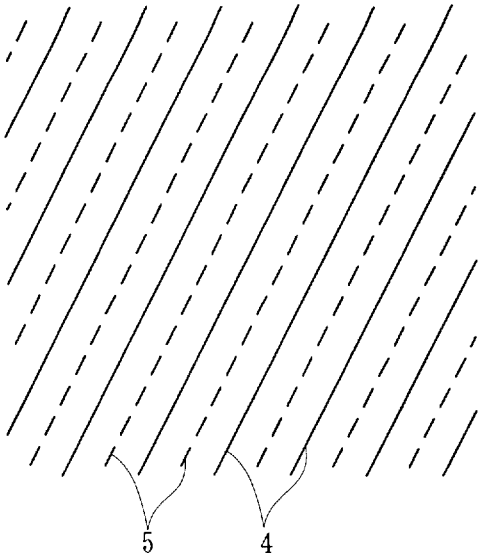
FIGS. 5(A), 5(B) and 5(C) are plan views showing other modifications of the bonding lines and the cutting portions in the cleaning product according to the present invention.
Figure 5A:
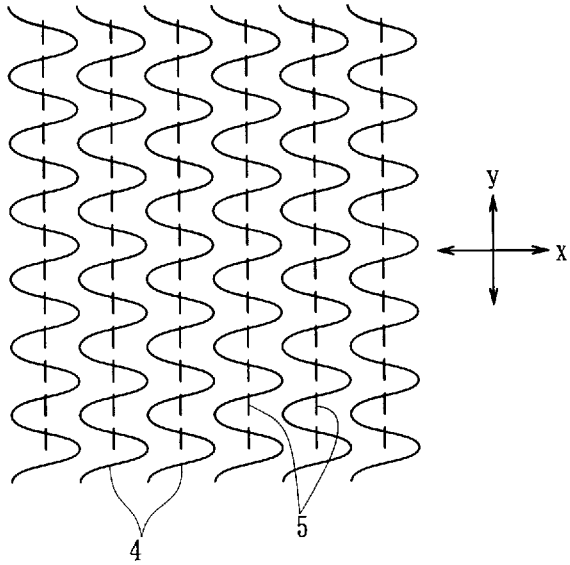
Figure 5C:
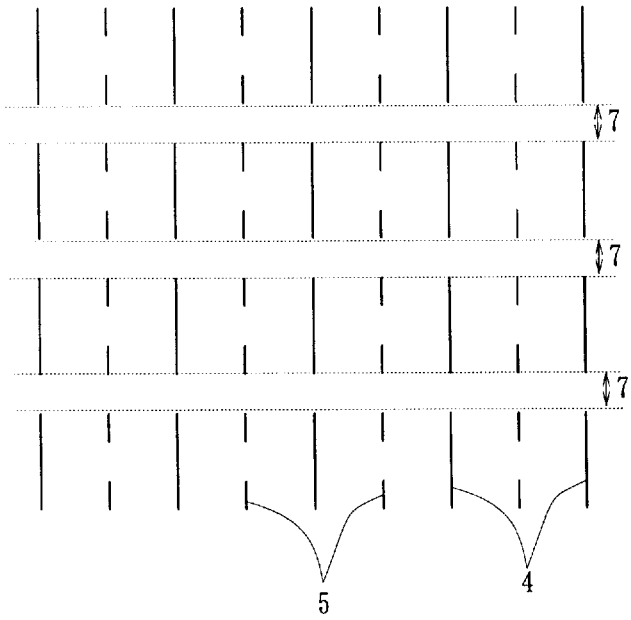

FIGS. 5(A), 5(B) and 5(C) are plan views showing other modifications of the bonding lines and the cutting portions in the cleaning product according to the present invention.

In each of FIGS. 5(A), 5(B) and 5(C), the filaments or the split yarns extend in the direction "x". In FIG. 5(A), the bonding lines 4 are not linear but corrugated. The cutting portions 5 are formed intermittently while intersecting the corrugating bonding lines 4.

Further, in FIG. 5(B), the bonding lines 4 are disposed in an oblique direction relative to the direction along which the filaments or the split yarns extend (direction "x"). Oblique disposition of the bonding lines 4 provides a merit that the bonding lines 4 can be formed easily in the production process. The cleaning product having the corrugated bonding lines 4 shown in FIG. 5(A) or the oblique bonding lines 4 shown in FIG. 5(B) can easily collect dusts in all directions upon use.

Further, the bonding lines 4 may not necessarily be a continuous line but may be formed intermittently as shown in FIG. 5(C). In this case, it is preferred that the cutting portions 5 are always formed in regions between the bonding lines 4 adjacent in the direction "x" such that the filaments or the split yarns are not detached from the main body of the cleaning product. That is, it is preferred that the cutting portions 5 are not formed in regions 7 in which the bonding lines 4 are not present as shown in FIG. 5(C). Further, the bonding lines may be of a zig-zag shape.

Figure 6:
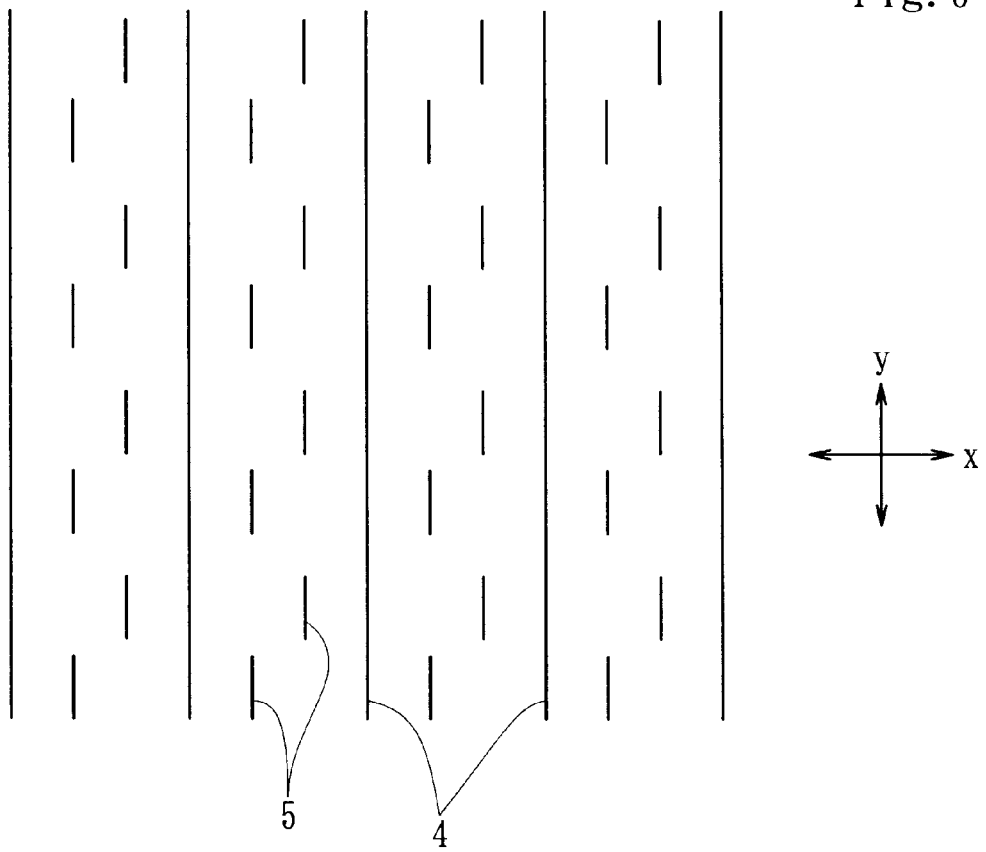
FIG. 6 is a plan view showing a further modification of the bonding lines and the cutting portions in the cleaning product according to the present invention.

FIG. 6 is a plan view showing still another modification of the bonding lines and the cutting portions of the cleaning product according to the present invention.

As shown in FIG. 6, two cutting lines apart from each other in the direction "x" are positioned between the bonding lines 4 and 4 adjacent with each other, wherein the cutting portions 5 constituting two cutting lines are arranged not to overlap with each other in the direction "y".

Further, the cutting portions may be of any shape as long as the filaments or split yarns are not detached from the main body of the cleaning product by cutting between the bonding lines adjacent with each other. For example, the cutting portion 5 may be formed intermittently so as to form a perforated line or a dotted line, or short cutting portions 5 may be formed at random. Further, the strength of the cleaning product can be adjusted by controlling the place where the cutting portions are formed. The number of cutting lines formed between bonding lines adjacent with each other may be optional.

Further, when the layer 3 is formed with the tow, the layer may be constituted by stacking two or three layers of filaments of different diameters (denier values). Further, a layer comprising filaments of a predetermined denier value and a layer comprising split yarns of a different denier value may be stacked to form the layer. In these cases, it is possible to catch dusts of different sizes effectively by the brushing portions 6.

Figure 7:
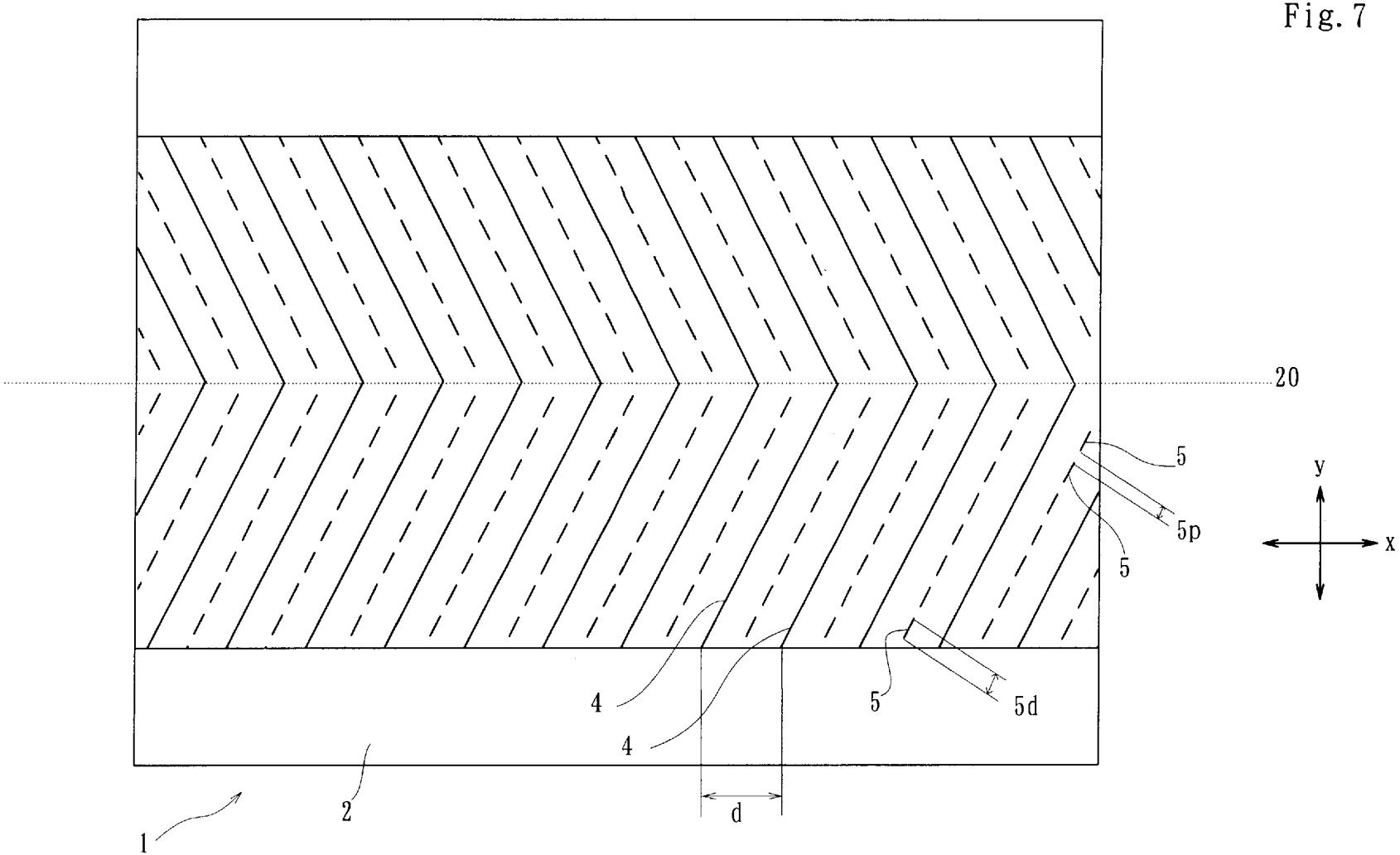
FIG. 7 is a plan view showing another example of the cleaning product according to the present invention.

FIG. 7 is a plan view showing another example of the cleaning product according to the present invention. In FIG. 7, the cleaning product has symmetrical pattern of bonding lines and cutting portions shown in FIG. 5(B) about the centerline 20 passing through the center of the cleaning product 1 in the direction "y". When the cleaning product 1 of the present invention is used being attached to a cleaning mop 10, it provides excellent dust collecting effect even if sweeping is conducted in the direction "x", the direction "y" or other directions.

In the present invention, a pitch of the bonding lines, namely, a predetermined distance "d" between the bonding lines 4 adjacent to each other in the direction "x" is preferably 5–50 mm. If it is less than 5 mm, the length of the brushing portion 6 is so short that it is difficult to collect dust. If it is more than 50 mm, it is difficult to fluff the brushing portion 6, and the cleaning product 1 has not good appearance. More preferably, the predetermined distance "d" is about 20 mm. A preferable length 5*d* of the cutting portion 5 is about 4 mm. A preferable interval 5p between the cutting portions 5 is about 1 mm.

In the present invention, furthermore, composite fibers comprising (1) polyethylene terephthalate as a core component and polyethylene as a sheath component, (2) polyethylene terephthalate as a core component and a sheath component, (3) polyethylene terephthalate as a core component and polypropylene as a sheath component, (4) polypropylene as a core component and a sheath component or (5) polypropylene as a core component and polyethylene as a sheath component may be used as filaments. A denier of the composite fiber is preferable 1–50 d/f, more preferable 2–10 d/f.

It is preferable that the base sheet 2 is a spunbond non-woven fabric made of the composite fibers comprising polyethylene terephthalate as a core component and polyethylene as a sheath component, with respect to the strength.

As mentioned above, the cleaning product of the present invention can effectively collect dust and hair by the brushing portions. Further, relatively large crumbs can be caught and retained inside of the layer where uncut filaments or split yarns remains. Accordingly, the relatively large crumbs hardly fall from the cleaning product. And the floor is hardly damaged because the relatively large crumbs caught inside of the layer would not appear at the surface of the cleaning product while wiping the floor. Furthermore, even in the case that the cleaning product is used for wiping of an uneven surface, the brushing portions of the cleaning product can effectively collect dust.

What is claimed is:

1. A cleaning product comprising a base sheet and a layer comprising at least one of fibers and rectangular materials oriented in one direction, said layer being placed on one face or both faces of said base sheet and bonded thereto at a plurality of bonding lines intersecting said one direction, wherein slits are formed in said intersecting direction between said bonding lines by partially cutting through both said base sheet and said layer such that said layer has uncut portions which remain between two bonding lines where one of said fibers and said rectangular materials are extended between said two bonding lines and fixed to the base sheet by said two bonding lines.

2. A cleaning product according to claim 1, wherein each of the bonding lines are in a wavy pattern.

3. A cleaning product according to claim 1, wherein said layer contains fibers having different denier values.

4. A cleaning product according to claim 1, wherein said base sheet and said layer contain thermoplastic resin and the bonding lines are formed by welding said base sheet and said layer.

5. A cleaning product according to claim 1, wherein each of the bonding lines extends continuously.

6. A cleaning product according to claim 1, wherein said layer contains an oily agent.

7. A cleaning product according to claim 1, wherein one of cut fibers and rectangular materials between said two bonding lines are raised apart from the surface of said base sheet to form brushing portions.

8. A cleaning product according to claim 7, wherein slits located between said two bonding lines are arranged at intervals on an axis which is parallel to the bonding lines.

9. A cleaning product according to claim 8, wherein said bonding lines and said slits extend obliquely with respect to said one direction.

10. A cleaning product according to claim 9, wherein individual bonding lines extend symmetrically about a center line of the cleaning product.

11. A cleaning product according to claim 10, wherein said bonding lines are in a "V" shaped pattern and have peaks which are aligned with the center line.

12. A cleaning product according to claim 11, wherein said bonding lines and said slits are formed in a latitudinal direction in a center region of the cleaning product such that said bonding line and slits are absent from side regions of the cleaning product in the latitudinal direction.

13. A cleaning product according to claim 12, wherein a length of each slit is longer than the interval between the slits.

14. A cleaning product according to claim 1, slits located between said two bonding lines are arranged at intervals on an axis which is parallel to the bonding lines.

15. A cleaning product according to claim 14, wherein said bonding lines and said slits extend obliquely with respect to said one direction.

16. A cleaning product according to claim 15, wherein individual bonding lines extend symmetrically about a center line of the cleaning product.

17. A cleaning product according to claim 16, wherein individual bonding lines are in a "V" shaped pattern having peaks which are aligned with the center line.

18. A cleaning product according to claim 17, wherein said bonding lines and said slits are formed in a latitudinal direction in a center region of the cleaning sheet such that said bonding line and slits are absent from side regions of the cleaning product in the latitudinal direction.

19. A cleaning product according to claim 18, wherein a length of each slit is longer than the interval between the slits.

20. A cleaning product according to claim 1, wherein slits between said two bonding lines are located closer to one of said two bonding lines than another of said two bonding lines.

21. A cleaning product according to claim 13, wherein slits between said two bonding lines are located closer to one of said two bonding lines than another of said two bonding lines.

22. A cleaning product according to claim 19, wherein slits between said two bonding lines are located closer to one of said two bonding lines than another of said two bonding lines.

23. A cleaning product according to claim 1, wherein each of the bonding lines extends intermittently.

24. A cleaning product according to claim 1, wherein said fibers are crimped.

25. A cleaning product according to claim 1, wherein a distance between adjacent bonding lines is from 5 to 50 millimeters.

26. A cleaning product according to claim 1, wherein a distance between the bonding lines and the slits in said one direction is at least 3 millimeters.

27. A cleaning product according to claim 6, wherein said oily agent absorbs dust.

* * * * *